US005377637A

United States Patent [19]

Leighton et al.

[11] Patent Number: 5,377,637

[45] Date of Patent: Jan. 3, 1995

[54] METHOD AND APPARATUS FOR METERING OIL FOR A TWO STROKE CYCLE INTERNAL COMBUSTION ENGINE

[75] Inventors: Sam R. Leighton, Nedlands; Claudio Pracilio, Balcatta; Raymond J. Hill, Palm Springs, all of Australia

[73] Assignee: Orbital Engine Company (Australia) Pty. Limited, Balcatta, Australia

[21] Appl. No.: 133,166

[22] PCT Filed: Jun. 19, 1992

[86] PCT No.: PCT/AU92/00301

§ 371 Date: Oct. 25, 1993

§ 102(e) Date: Oct. 25, 1993

[87] PCT Pub. No.: WO93/00502

PCT Pub. Date: Jan. 7, 1993

[30] Foreign Application Priority Data

Jun. 21, 1991 [AU] Australia ..... PK6788

[51] Int. Cl.[6] ..... F01M 1/00

[52] U.S. Cl. ..... 123/73 AD

[58] Field of Search ..... 123/73 AD, 196 R, 73 C

[56] References Cited

U.S. PATENT DOCUMENTS

| | | | |
|---|---|---|---|
| 4,403,578 | 9/1983 | Iwai et al. | 123/73 AD |
| 4,539,949 | 9/1985 | Walsworth | 123/73 |
| 4,765,291 | 8/1988 | Kurio | 123/73 AD |
| 5,024,190 | 6/1991 | Kameyama | 123/73 AD |
| 5,103,777 | 4/1992 | Daikoku | 123/73 AD |
| 5,315,971 | 5/1994 | Yamada | 123/73 AD |

FOREIGN PATENT DOCUMENTS

| | | |
|---|---|---|
| 88347/82 | 4/1983 | Australia . |
| 384597 | 11/1923 | Germany . |
| 1-262359 | 10/1989 | Japan . |
| 1296334 | 11/1972 | United Kingdom . |
| 2134989 | 8/1984 | United Kingdom . |

*Primary Examiner*—E. Rollins Cross
*Assistant Examiner*—M. Macy
*Attorney, Agent, or Firm*—Nikaido, Marmelstein, Murray & Oram

[57] ABSTRACT

A method of control of the supply of lubricating oil to a two stroke cycle internal combustion engine comprising supplying fuel to a fuel injector from a fuel reservoir having a fuel capacity greater than the maximum fuel requirement of the engine per cycle. The fuel in the reservoir being maintained at a substantially steady pressure. Delivering oil to the engine by a positive displacement pump having a delivery capacity per pump cycle greater than the maximum oil requirement of the engine per cycle. The oil pump being activated in response to the consumption of fuel from the fuel reservoir to maintain a substantially uniform predetermined ratio between the fuel consumption rate and the oil delivery rate.

18 Claims, 4 Drawing Sheets

METHOD AND APPARATUS FOR METERING OIL FOR A TWO STROKE CYCLE INTERNAL COMBUSTION ENGINE

This invention relates to the control of the supply of oil to a two stroke cycle engine wherein the introduction of the oil to the engine is separate from the introduction of the fuel.

With the increasing requirement to reduce the emissions of internal combustion engines, it has been recognised that controls must be introduced in respect of the level of exhaust emission from a range of engines other than automotive engines, particularly in regard to marine engines for pleasure craft and engines for motor bikes and motor scooters. There are also under consideration restrictions on the emissions from various forms of stationary internal combustion engines and equipment employing relatively small capacity internal combustion engines such as lawn mowers and bush cutters.

A large proportion of these small engines operate on the two stroke cycle principle, primarily because of the relatively low weight and cost of manufacture of two stroke cycle engines. However, the majority of two stroke cycle engines currently in use effect lubrication of the engine by introducing lubricating oil into the fuel which then passes through the crankcase compartment of the respective cylinders before the fuel enters the cylinder to be ignited and combusted. Although the mixing of the oil with the fuel is very convenient and a relatively cheap means of conveying the lubricating oil to the various areas of the engine, it does aggravate the problem of exhaust emissions.

Mechanical oil metering devices are also used in conjunction with two stroke cycle engines, usually controlled from the throttle linkage to regulate the oil supply relative to engine load. The oil is delivered into the fuel or directly into the engine, or in a crankcase compression two stroke cycle engine into the air in the crankcase.

It has been established that the most effective control of exhaust emissions, particularly in two stroke cycle engines, is attained by directly injecting the fuel into the combustion chamber, however, with such direct injecting systems, the fuel may not be used as the carrier for the lubricating oil, as the fuel does not enter the engine crankcase where the principal components requiring effective lubrication are located.

In automobiles having relatively large capacity engines, it is economically acceptable to provide an engine management system incorporating an electronic control unit which can be programmed to control an appropriate lubrication system for the engine, in addition to controlling the operation of the fuel injection system. However, the costs of such engine management systems are too high to permit the use thereof in controlling the operation of low cost small capacity engines such as small marine engines, motor bike and scooter engines and lawnmower engines.

It is therefore the object of the present invention to provide a method and apparatus for the supply of fuel and lubricant to a two stroke cycle internal combustion engine which is effective and reliable in controlling the rate of supply of lubricant to the engine and may be manufactured in high volume at a comparatively low cost.

With this object in view, there is provided a method of control of the supply of lubricating oil to a two stroke cycle internal combustion engine comprising delivering fuel to the engine from a fuel reservoir, cyclically filling said reservoir with a quantity of fuel at least equal to the engine fuel requirement for a plurality of engine cycles at maximum engine fuel consumption rate, delivering oil to the engine by positive displacement pump means having a delivery rate per pump cycle greater than the maximum oil requirement of the engine per engine cycle, activating said oil pump in response to and simultaneously with the consumption of fuel from said reservoir, and controlling the delivery of oil during each pump cycle to maintain a substantially uniform predetermined ratio between the quantity of fuel and quantity of oil delivered to the engine per engine cycle, the method allowing oil and fuel to be delivered separately to the engine.

There is also provided as a further aspect of the present invention an oil metering apparatus to control the supply of oil to a two stroke cycle internal combustion engine comprising positive displacement pump means to deliver oil to the engine and having a capacity per pump cycle greater than the maximum oil requirement of the engine per engine cycle, a fuel supply reservoir having a fuel capacity at least equal to the engine fuel requirement for a plurality of engine cycles at maximum engine fuel consumption rate, means to maintain said fuel in the reservoir at a substantially steady pressure for supply to fuel metering means, means operable in response to and simultaneously with the consumption of fuel from said reservoir to activate said pump means, and means to control the delivery of oil during each pump means cycle to maintain a substantially steady predetermined ratio between the quantity of fuel and quantity of oil delivered to the engine per engine cycle, the apparatus enabling the separate delivery of oil and fuel to the engine.

Conveniently, the fuel supply reservoir has a wall section that moves in response to the consumption of fuel from the reservoir, that wall section being operably connected to the oil pump so that the rate of delivery of oil by the oil pump is proportional to the movement of said wall section of the fuel supply reservoir. Preferably the oil pump means is a piston pump, with the wall section of the fuel supply reservoir directly coupled to the piston or cylinder of the oil pump, to thereby effect relative movement between the piston and cylinder proportioned to the movement of said wall section of the fuel reservoir to effect delivery of the oil.

In accordance with another aspect of the invention, there is provided a fuel metering device comprising a fuel reservoir, a metering chamber, a metering member having an end portion thereof projecting into said metering chamber, and an intermediate portion extending into said fuel reservoir and providing a passage communicating said fuel reservoir with said metering chamber, valve means arranged to, permit fuel to flow through said passage only from the reservoir to said metering chamber, whereby, as the metering member moves in one direction, fuel is discharged from said metering chamber and, in the other direction, fuel flows from the reservoir to the metering chamber to fill the latter, means to effect reciprocation of said metering member in the metering chamber to effect delivery of fuel from the chamber, and means to control the extent of said reciprocation to vary the quantity of fuel delivered to thereby meter the fuel to the engine.

Conveniently, the metering member extends through the fuel reservoir and has an aperture in the wall thereof providing communication, preferably continuously, between the reservoir and the passage in the metering member. The metering member is operatively connected to drive means, such as a piston means movable in a cylinder, to effect said reciprocation, the stroke of said drive means or piston being variable in response to the fuel demand to control the metered quantity of fuel delivered.

The above described fuel metering device may be used in conjunction with the previously described oil metering means or independently thereof.

Another aspect of the invention relates to a method of delivering a metered quantity of fuel to an engine wherein the fuel may be metered as described above or another appropriate method, preferably a method using a positive displacement means for the delivery of the fuel to the injector means.

One convenient method of delivering a metered quantity of fuel to an internal combustion engine having fuel injection means including an injector chamber and a selectively operable nozzle to communicate said injector chamber with a combustion chamber of the engine when open, comprises opening said nozzle during the compression portion of the engine cycle to deliver fuel through the nozzle to the combustion chamber, delivering gas from the combustion chamber into the injector chamber through said nozzle after delivery of the fuel to the combustion chamber and preferably before ignition of the fuel in the combustion chamber, and delivering a metered quantity of fuel into the gas in the injector chamber, preferably after closure of the nozzle, for delivery to the combustion chamber during the compression portion of the next engine cycle by the gas in the injector chamber.

Although the delivery of the gas from the combustion chamber may continue after ignition of the fuel it is desirable to complete that delivery before the flame front reaches the nozzle, although in some situation some combustion products may pass through the nozzle into the injection chamber.

One practical arrangement of the invention will now be described with reference to the accompanying drawings, wherein there is illustrated one practical arrangement of the oil and fuel metering devices respectively.

Figure 1:
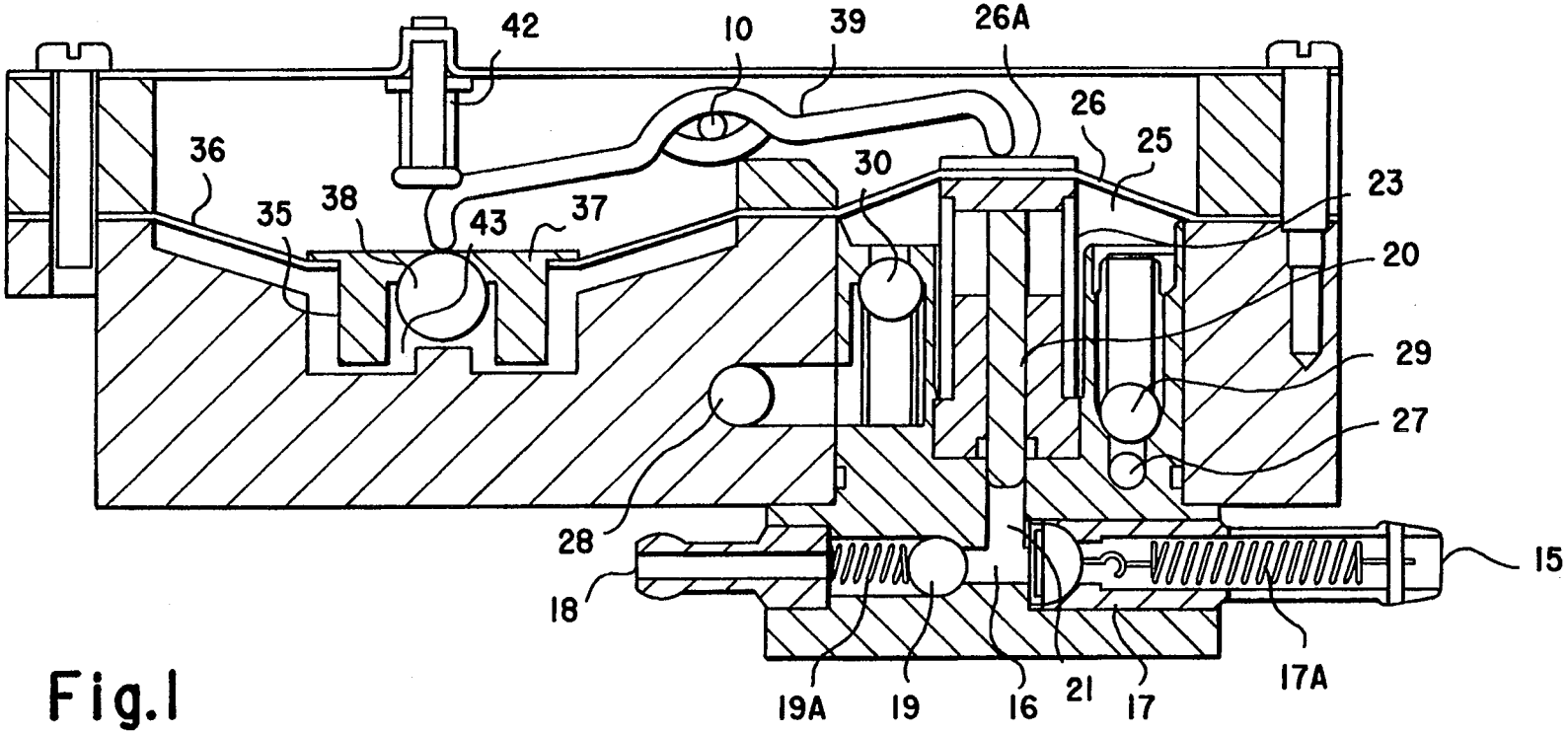
FIG. 1 is a cross-sectional view of the fuel supply and oil metering unit.

Referring now to FIG. 1 of the accompanying drawings, there is shown a cross-sectional view through the fuel and oil pump unit which includes the oil metering device.

The oil entry nipple 15 is connected to an oil reservoir (not shown) to supply oil to the oil gallery 16 via the one-way valve 17 biased by the spring 17A to a closed position. Oil is delivered from the gallery 16 via the nipple 18 under the control of the one-way valve 19 biased toward the closed position by the spring 19A. The oil metering rod 20 is a close sliding fit in the oil pump chamber 21 forming pan of the oil gallery 16.

Movement of the metering rod 20 in an upward direction as seen in FIG. 1 will draw oil into the gallery 16 from the oil supply reservoir via the valve 17. Downward movement of the metering rod 20 will discharge oil from the gallery 16 through the nipple 18 via the valve 19. The nipple 18 is connected by an appropriate pressure line or lines and/or duct or ducts to deliver oil to the appropriate location in the engine.

In a multi cylinder engine the gallery 16 and metering rod 20 may be appropriately dimensioned so that the one oil metering unit can supply oil to lubricate all parts of the multi cylinder engine. Alternatively, individual oil metering units of the same construction may be provided to supply lubricant to each cylinder and the associated bearings.

The oil metering rod 20 projects into the fuel reservoir or supply chamber 25 and is connected centrally to the diaphragm 26, which forms one wall of the fuel chamber 25. The fuel chamber 25 communicates with the fuel supply duct 27 and fuel delivery duct 28 via respective one-way valves 29 and 30 so that movement of the diaphragm 26 upwardly as seen in FIG. 1 will draw fuel into the chamber 25 and upon downward movement will deliver fuel from chamber 25 to a fuel metering unit, described further hereinafter. It will be appreciated that, as shown in FIG. 1, the diaphragm 26 is in its extended position so that the fuel chamber 25 is filled to its maximum capacity with fuel and thus the oil metering rod 20 is in its uppermost position, with the oil gallery 16 also filled with oil.

As fuel is consumed by the fuel injection unit, the diaphragm 26 will move downwardly and in turn cause the oil metering rod 20 to also move downwardly. As the metering rod 20 is rigid with the central portion 26A of the diaphragm 26, they each move downwardly in unison and thus oil is displaced from the gallery 16 at a rate directly proportional to the rate of consumption of fuel from the fuel chamber 25. It is thus seen that the mechanism above described provides a very simple, reliable and effective means for the metering of the oil to the engine at a rate directly related to the rate of fuel consumption.

In order to provide the force necessary to effect delivery of the fuel and oil, the underside of the diaphragm 36 is directly subjected to a substantially steady gas pressure in the chamber 35, that pressure corresponding to the near peak pressure achieved in the crankcase compartment of the two stroke cycle engine during each cycle. A pressure actuated valve of the conventional check valve type (not shown) is provided to selectively communicate the crankcase with the chamber 35 to achieve this pressure condition in the chamber 35. The lever 39 is pivotally supported at 10 to transmit the force generated on the diaphragm 36 to the diaphragm 26 thus obtaining a multiple of the pressure in the chamber 35 in the fuel chamber 25 due to the difference in areas of the two diaphragms 26 and 36 and adjusted by the effects of the spring 23 and the pressure of the oil in the gallery 16.

As the fuel is consumed from the fuel chamber 25, the diaphragm 36 will move upwardly as viewed in FIG. 1 until the adjustable stop 42 contacts the ball 38 located in the seat 37 carried by the diaphragm 36. The chamber 35 is thereby vented to atmosphere and the ball 38 will then return to rest on the fixed projection 43, and the diaphragm 36 will move downwardly until the seat 37 again engages the ball 38. At the same time the spring 23 will move the diaphragm 26 upwardly whereby fuel is drawn into the chamber 25 through the valve 29 27 and oil is drawn into the gallery 16 through the valve 17, and the cycle is then repeated.

It will be appreciated from the above described construction and operation of the combined fuel and oil supply system that, as the diaphragm 26 and metering rod 20 move in unison, driven by the diaphragm 36 and lever 39, a substantially fixed relation will be maintained between the rate of fuel supply and rate of oil supply to the engine.

Figure 2:
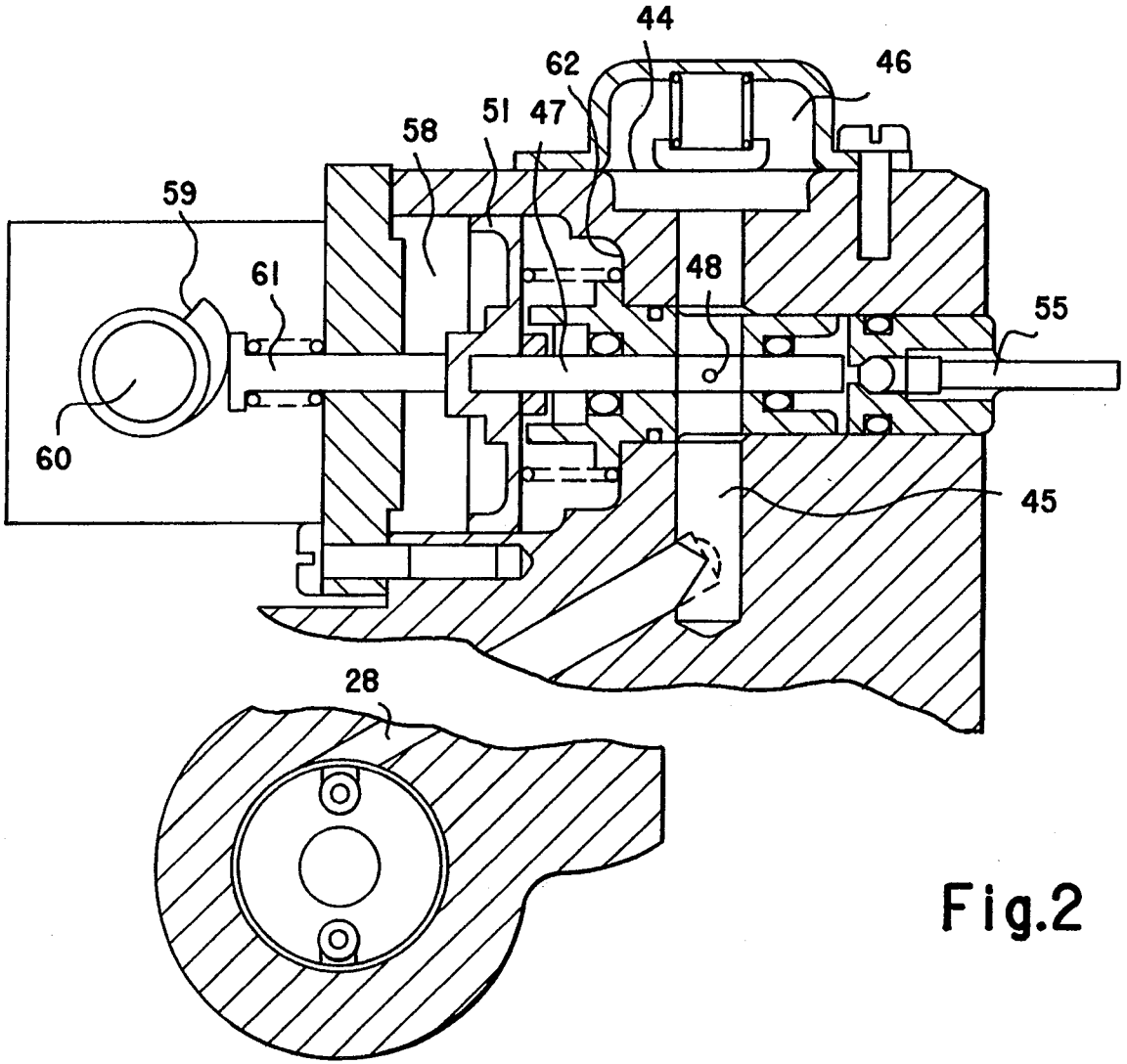
FIG. 2 is a cross-sectional view of the fuel metering unit.
Figure 3:
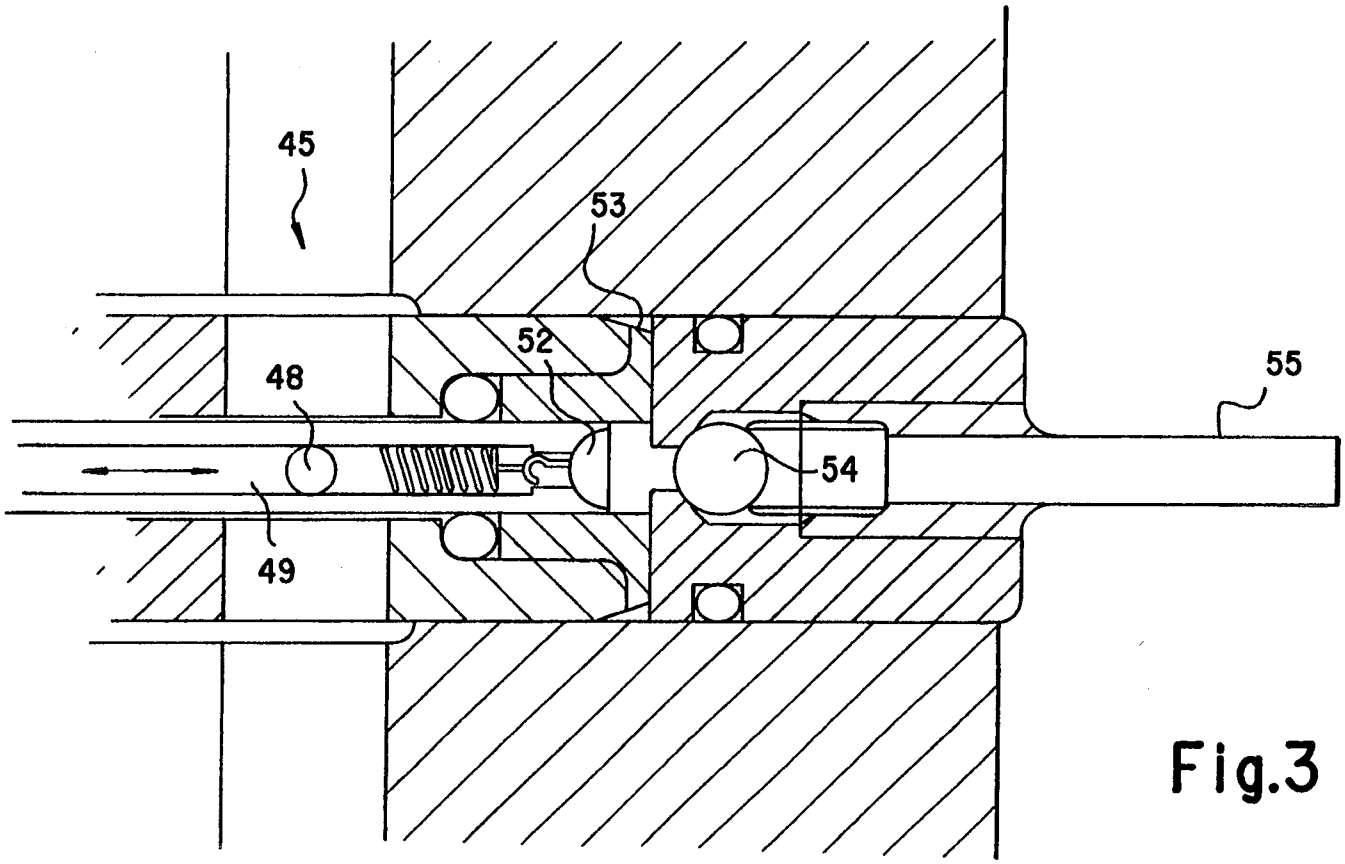
FIG. 3 is an enlarged cross-sectional view of the metering chamber and metering rod portion of the fuel metering unit shown in FIG. 2.

Referring now to FIGS. 2 and 3, the fuel delivery passage 28, as referred to in the preceding description with respect to FIG. 1, supplies fuel to the fuel storage chamber 45 having a pressure damper 46 incorporated therein to maintain a substantially steady fuel pressure in the chamber 45. The damper 46 comprises a spring loaded diaphragm 44. Extending through the fuel chamber 45 is a hollow fuel metering rod 47 having an aperture 48 in the wall thereof to provide continuous communication between the fuel storage chamber 45 and the internal cavity 49 in the fuel metering rod 47. The fuel metering rod 47 is closed at the upper end by the piston 51 to which it in rigidly secured.

The lower end of the metering rod 47 is located in the metering chamber 53 (FIG. 3) and is axially movable therein to vary the fuel capacity of the metering chamber. The one-way valve assembly 52 at the lower end of the metering rod controls communication between the internal cavity 49 of the metering rod 47 and the fuel metering chamber 53. The one-way valve 54 at the opposite end of the metering chamber 53 controls the flow of the fuel from the metering chamber 53 into the conduit 55 to conduct the fuel to the delivery point to the engine.

The piston 51 rigidly connected to the metering rod 47 moves in the cylinder 58 in response to the application of fluid pressure in the cylinder 58. The application of this fluid pressure will displace the piston 51 and the fuel metering rod 47 to the right as seen in FIG. 2, and in doing so will cause the one-way valve 52 to close and the one-way valve 54 to open, so that the fuel in the fuel chamber 53 is discharged through the delivery conduct 55. It will thus be seen that by varying the stroke of the piston 51 and hence of the metering rod 47, the quantity of fuel delivered to the engine during each stroke of the metering rod 47 may be varied to meet the engine fuel requirement.

The valve 52 and valve 54 are of conventional construction, each being spring loaded to a closed position. The valve 52 in the metering rod 47 opens when the pressure in the internal cavity 49 is above the pressure in the metering chamber 53 by a preset amount, and similarly the valve 54 opens when the pressure in the metering chamber is above that in the delivery conduit 55. The valve 52 opens at a lower pressure than the valve 54.

In order to achieve the variation in the quantity of fuel delivered to the engine, the cam 59 is rotatably mounted on an axis 60 to co-operate with the adjustable piston stop 61 which controls the return position of the piston 51 in the cylinder 58. The extent of travel of the piston to the right in FIG. 2 is fixed by the annular shoulder 62. Thus as the piston stop 61 is moved towards the shoulder 62, to the right as seen in FIG. 2, the stroke of the fuel metering rod 47 is reduced and consequently the quantity of fuel delivered from the fuel metering chamber 53 each piston stroke, is reduced and vice-versa.

Accordingly, by controlling the stroke of the piston 51 through the operation of the cam 59, the fuelling rate to the engine can be varied. Operation of the cam 61 is directly driver controlled, or may be controlled through an appropriate ECU, so that the quantity of fuel delivered to the engine is correct for the engine load and speed.

Conveniently the fluid supplied to the cylinder 58 to actuate the piston 51 can be air which is derived from the pumping action in the crank case of a two stroke, cycle engine via a suitable pressure control device. The air pressure can be derived from the same source as that used to actuate the diaphragm 36 as previously referred to with respect to the description relating to FIG. 1 of the drawings. The timing of the application of the air pressure to the piston is regulated in a known manner to effect the delivery of the fuel at the desired point in the engine cycle. The fuel may be delivered via the conduit 55 directly to an injector nozzle with the pressure of the fuel being sufficient to inject into the air induction system or the combustion chamber of the engine, or to an appropriate form of fuel injector.

It is to be understood that the fuel and oil supply system as described with respect to FIG. 1 of the drawings, may be used to supply fuel to a fuel metering device of an alternative construction to that shown in FIGS. 2 and 3. Equally the fuel metering device as described with respect to FIGS. 2 and 3 may be used with an alternative fuel supply to that described with reference to FIG. 1.

Figure 4:
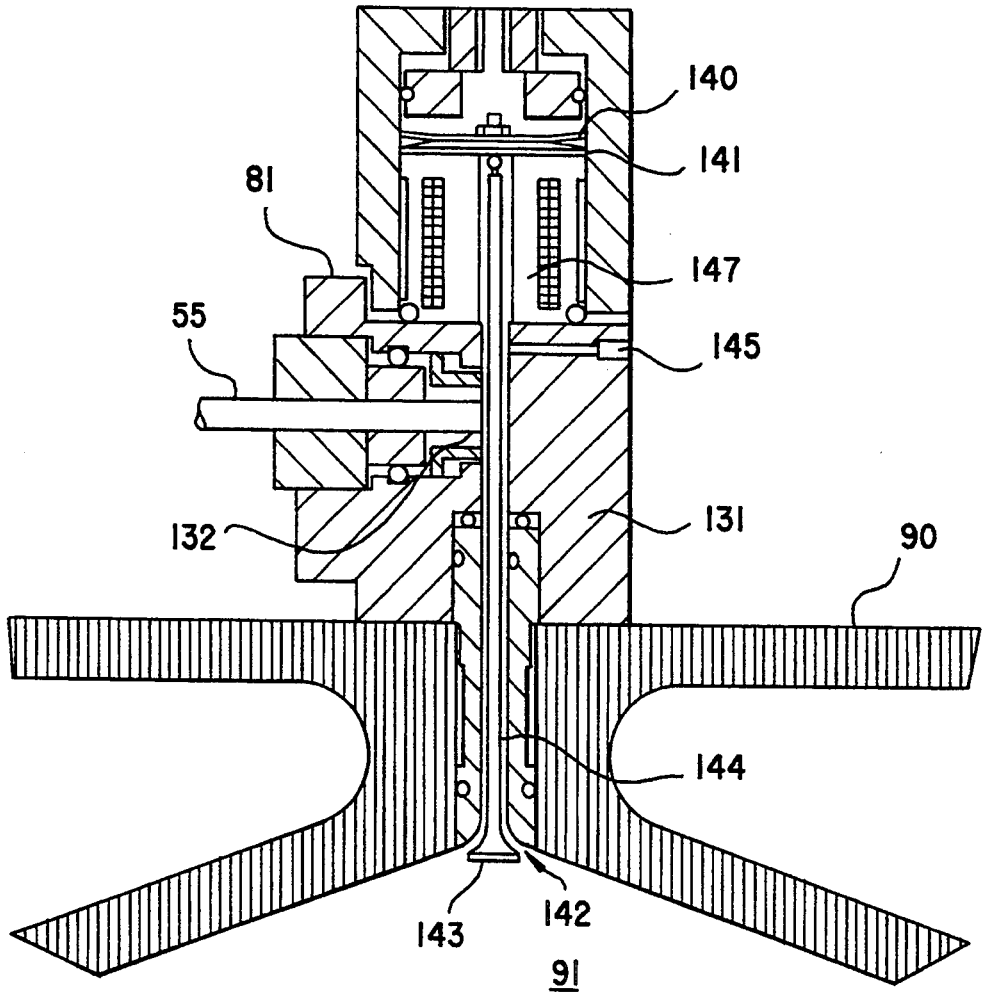
FIG. 4 is a sectional view of the injector unit.

Referring now to FIG. 4 there is illustrated therein a fuel injector unit 81 mounted directly on the cylinder head 90 of an internal combustion engine.

The metered quantity of fuel is delivered from the fuel metering unit described with respect to FIG. 2 and 3 via the conduit 55 to the fuel chamber 132 once per engine cycle in accordance with the engine fuel demand.

The valve 143 of the injector nozzle 142 is coupled, via a valve stem 144, which passes through the fuel chamber 132, to the armature 141 of the solenoid 147 located within the injector body 131. The valve 143 is biased to the closed position by the disc spring 140 and is opened by energising the solenoid 147. The valve 143 is shown in the open position in FIG. 4. Energising of the solenoid 147 is controlled by an ECU (not shown) in timed relation to the engine cycle to effect delivery of the fuel from the fuel chamber 132 to a cylinder of the engine.

The fuel chamber 132 is charged with air at a substantially steady pressure from a suitable source. By energising the solenoid 147, the valve 143 is displaced downwardly to open the nozzle 142 so that the metered quantity of fuel held in the fuel chamber 132 is carried by the high pressure air charge out of the fuel chamber 132 through the nozzle 142 into the combustion chamber 91 of a cylinder of the engine, The timing of the delivery of the fuel to the engine combustion chamber is controlled by an ECU in a known manner. The high pressure air in the fuel chamber may be provided from an external source via the air inlet port 145. Alternatively the port 145 may be omitted from the injector unit and the high pressure gas derived from the engine combustion chamber.

This can be achieved by maintaining the nozzle 142 open for a period of time after the completion of the injection of the fuel when the gas pressure in the combustion chamber 91 is still rising. In this way gas (largely air), at a pressure above that in the combustion chamber at the time of injection, is delivered into and trapped in the fuel chamber 132 in preparation for the delivery of the fuel during the next engine cycle. The nozzle is preferably closed before combustion products from the engine cylinder can enter the fuel chamber 132, and conveniently before ignition of the fuel takes place. The trapping of high pressure gas from the combustion chamber in the fuel chamber of the injector eliminates the need for a compressor to provide the supply of gas at a pressure sufficient to effect injection of the fuel.

It is to be understood that the method and apparatus for metering the supply of lubricating oil to an engine described herein can be applied to engines using alternative forms of fuel metering and delivery from the practical arrangements described herein. In particular the method and apparatus can be used in conjunction with engines having a fuel injection system wherein fuel alone is injected as distinct from the system described herein where the fuel is injected entrained in air. The fuel can be injected directly into the engine combustion chamber or into the engine air induction system. Also the fuel can be supplied by a carburettor fuel system.

We claim:

1. A method of control of the supply of lubricating oil to a two stroke cycle internal combustion engine comprising delivering fuel to the engine from a fuel reservoir, cyclically filling said reservoir with a quantity of fuel at least equal to the engine fuel requirement for a plurality of engine cycles at maximum engine fuel consumption rate, delivering oil to the engine by positive displacement pump means having a delivery rate per pump means cycle greater than the maximum oil requirement of the engine per engine cycle, activating said oil pump means in response to and simultaneous with the consumption of fuel from said reservoir, and controlling the delivery of oil during each pump means cycle to maintain a substantially uniform predetermined ratio between the quantity of fuel and quantity of oil delivered to thee engine per engine cycle, said method allowing oil and fuel to be delivered separately to tile engine.

2. A method as claimed in claim 1 including displacing a portion of a wall defining said fuel reservoir from an original position occupied when the reservoir is full of fuel in response to delivery of fuel from said fuel reservoir, and activating said pump means in response to the displacement of said wall portion.

3. A method as claimed in claim 2 including applying a load to said wall portion to maintain the fuel in the reservoir at a substantially steady pressure.

4. A method as claimed in claim 2 including refilling said fuel reservoir in response to a predetermined amount of movement of said wall portion away from the original position occupied when the reservoir is full of fuel.

5. A method as claimed in claim 3 including applying the load to said wall portion from a fluid pressure source to pressurise the fuel in the reservoir, venting said fluid pressure after the wall portion has been displaced a predetermined amount, returning said wall portion to the original position, re-filling the reservoir and re-applying the fluid pressure.

6. A method as claimed in claim 5 including drawing fuel into the reservoir to refill the reservoir in response to said return movement of the wall portion.

7. A method as claimed in claim 5 including supplying said fluid pressure by bleeding compressed gas from at least one combustion chamber.

8. A method as claimed in claim 1 including activating said pump means in response to tile displacement of a wall portion of the fuel reservoir.

9. A method as claimed in claim 8 wherein said pump means comprises a member projecting into a fixed volume chamber, and said control of oil delivery is effected by increasing the extent of projection of said member in direct response to the displacement of said wall portion of the fuel reservoir, and thereby delivering oil to the engine.

10. A method as claimed in claim 9 wherein the member is coupled to said wall portion to move in unison therewith and including reducing the extent of projection of said member into said chamber as the wall portion is returned to the original position thereby drawing oil into said chamber to refill the chamber with oil.

11. An oil metering apparatus to control the supply of oil to a two stroke cycle internal combustion engine comprising positive displacement pump means to deliver oil to the engine and having a capacity per pump means cycle greater than the maximum oil requirement of the engine per engine cycle, a fuel supply reservoir having a fuel capacity at least equal to the engine fuel requirement for a plurality of engine cycles at maximum engine fuel consumption rate, means to maintain said fuel in the reservoir at a substantially steady pressure for supply to fuel metering means, means operable in response to and simultaneously with the consumption of fuel from said reservoir to activate said pump means, and means to control the delivery of oil during each pump means cycle to maintain a substantially steady predetermined ratio between the quantity of fuel and quantity of oil delivered to the engine per engine cycle, said apparatus enabling the separate delivery of oil and fuel to the engine.

12. An oil metering apparatus as claimed in claim 11 wherein the means to control the delivery of the oil is adapted to maintain a substantially steady pressure ratio between the fuel in the reservoir and the oil delivered by the pump means.

13. An oil metering apparatus as claimed in claim 11 wherein the fuel reservoir is variable in volume as fuel is delivered therefrom so the reservoir is always full of fuel when in operation, and means are provided to cyclically supply fuel to said reservoir to return the reservoir to the maximum volume, and said pump means includes a chamber that varies in volume in response to the variation of the fuel reservoir volume and in direct proportional relation thereto.

14. An oil metering apparatus as claimed in claim 11 wherein the reservoir has a wall portion movable to vary the volume of the reservoir, and means are provided to apply a load to said wall portion to maintain said substantially steady pressure of the fuel as said reservoir volume varies.

15. An oil metering apparatus as claimed in claim 14 wherein said wall portion is operably coupled to said oil pump means so the rate of delivery of oil by the pump mean in relation to the volume variation of the reservoir is in accordance with said predetermined ratio.

16. An oil metering apparatus as claimed in claim 14 wherein said means to apply a load to said wall portion of the fuel reservoir includes a chamber having a movable wall section operably connected to the movable wall portion of the fuel reservoir, means to selectively communicate said chamber with a pressure gas source and to maintain gas pressure within said chamber substantially steady.

17. An oil metering apparatus as claimed in claim 16 wherein lever means are provided to transfer the force generated by the gas pressure in the chamber to the movable wall of the fuel reservoir.

18. An oil metering apparatus as claimed in claim 16 wherein said means to selectively communicate said chamber to a pressure gas source are adapted to connect to a crankcase of a two stroke cycle engine.

* * * * *

UNITED STATES PATENT AND TRADEMARK OFFICE

CERTIFICATE OF CORRECTION

PATENT NO. : 5,377,637

DATED : January 3, 1995

INVENTOR(S) : LEIGHTON et al.

It is certified that error appears in the above-identified patent and that said Letters Patent is hereby corrected as shown below:

Column 7, line 39, delete "thee" and insert --the--;

line 40, delete "tile" and insert --the--.

Column 8, line 2, delete "tile" and insert --the--.

Signed and Sealed this

Fourteenth Day of November, 1995

*Attest:*

Bruce Lehman

BRUCE LEHMAN

*Attesting Officer*

*Commissioner of Patents and Trademarks*